US012060814B2

(12) United States Patent
Hübner

(10) Patent No.: US 12,060,814 B2
(45) Date of Patent: Aug. 13, 2024

(54) SHIFTING STOPPER LATCH ASSEMBLY FOR ROCKER ARM

(71) Applicant: Eaton Intelligent Power Limited, Dublin (IE)

(72) Inventor: Zdenek Hübner, Kamen (CZ)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/261,454

(22) PCT Filed: Jan. 14, 2022

(86) PCT No.: PCT/EP2022/025014

§ 371 (c)(1),
(2) Date: Jul. 13, 2023

(87) PCT Pub. No.: WO2022/152580

PCT Pub. Date: Jul. 21, 2022

(65) Prior Publication Data

US 2024/0077005 A1 Mar. 7, 2024

Related U.S. Application Data

(60) Provisional application No. 63/137,865, filed on Jan. 15, 2021.

(51) Int. Cl.
*F01L 1/46* (2006.01)
*F01L 1/18* (2006.01)
(Continued)

(52) U.S. Cl.
CPC ..... *F01L 1/46* (2013.01); *F01L 1/181* (2013.01); *F01L 13/0005* (2013.01);
(Continued)

(58) Field of Classification Search
CPC ..... F01L 1/181; F01L 1/46; F01L 13/0005; F01L 2013/001; F01L 13/08
(Continued)

(56) References Cited

U.S. PATENT DOCUMENTS

2014/0182539 A1* 7/2014 Gron, Jr. ..... F02M 31/042 123/182.1
2019/0301316 A1* 10/2019 Tateno ..... F01L 1/18
2020/0182108 A1 6/2020 VanWingerden

FOREIGN PATENT DOCUMENTS

CN 111963270 A * 11/2020
WO WO 2011/156684 A2 12/2011
WO WO 2020/151924 A1 7/2020

OTHER PUBLICATIONS

International Search Report for intentional application PCT/EP2022/025014 dated Apr. 29, 2022.
(Continued)

*Primary Examiner* — Jorge L Leon, Jr.
(74) *Attorney, Agent, or Firm* — Baker Botts L.L.P.

(57) ABSTRACT

A shifting stopper latch assembly for a rocker arm can comprise a latch assembly housing, comprising a latch assembly oil feed, a piston bore, a stopper bore comprising a stopper opening, and a spring seat. A piston can be in the piston bore. A shifting stopper can be in the stopper bore and the shifting stopper can comprise a projection protruding out of the stopper opening. A return spring can be configured in the spring seat to bias the shifting stopper and the plunger away from the spring seat and towards the latch assembly oil feed. A valvetrain can comprise a rocker arm configured to actuate against a cam on a cam rail, and the rocker arm can comprise a latch surface configured to selectively engage and disengage the projection.

16 Claims, 5 Drawing Sheets

(51) Int. Cl.
*F01L 13/00* (2006.01)
*F01L 13/06* (2006.01)
*F01L 13/08* (2006.01)

(52) U.S. Cl.
CPC ..... *F01L 13/06* (2013.01); *F01L 13/08* (2013.01); *F01L 2013/001* (2013.01)

(58) Field of Classification Search
USPC ..... 123/90.39, 90.44
See application file for complete search history.

(56) References Cited

OTHER PUBLICATIONS

Written Opinion of the International Searching Authority intentional application PCT/EP2022/025014 dated Apr. 29, 2022.

* cited by examiner

SHIFTING STOPPER LATCH ASSEMBLY FOR ROCKER ARM

PRIORITY

This application claims the benefit under 35 U.S.C. § 371 of International Patent Application No. PCT/EP2022/025014, filed 14 Jan. 2022, which claims the benefit under 35 U.S.C. § 119(e) of U.S. Provisional Patent Application No. 63/137,865, filed 15 Jan. 2021, which are incorporated herein by reference.

FIELD

This application provides a shifting stopper latch assembly for a rocker arm and a rocker arm formed thereby.

BACKGROUND

Variable valve actuation techniques can result in large builds on the valvetrain with actuation pieces extending upward or behind the rocker arms. Room on the cylinder head is tight, which is why VVA parts typically move up or back. This also causes packaging issues in the engine compartment. Reliable, low part count, compact, lightweight switching is desired to move between variable valve lift profiles.

SUMMARY

The methods and devices disclosed herein overcome the above disadvantages and improves the art by way of a shifting stopper latch assembly for a valvetrain and the valvetrain formed thereby. A carrier for a valvetrain can also be formed. A valvetrain can comprise a rocker arm, a cam actuation system, and a shifting stopper configured to selectively act on the rocker arm. A type III rocker arm can be configured with a shifting stopper as shown and described. A type III rocker arm can be configured with a shifting stopper adjacent a roller or tappet as shown and described.

A shifting stopper latch assembly for a rocker arm can comprise a latch assembly housing, comprising a latch assembly oil feed, a piston bore, a stopper bore comprising a stopper opening, and a spring seat. A piston can be in the piston bore. A shifting stopper can be in the stopper bore and the shifting stopper can comprise a projection protruding out of the stopper opening. A return spring can be configured in the spring seat to bias the shifting stopper and the piston away from the spring seat and towards the latch assembly oil feed.

A valvetrain can comprise a rocker arm configured to actuate against a cam on a cam rail, and the rocker arm can comprise a latch surface configured to selectively engage and disengage the projection.

The rocker arm can comprise a body extension adjacent a bearing surface of a cam end. The latch surface can be integrated with the body extension. The latch housing can be at least partially nested under the body extension. And, when included, the rocker arm extension can be at least partially nested under the body extension.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1B:
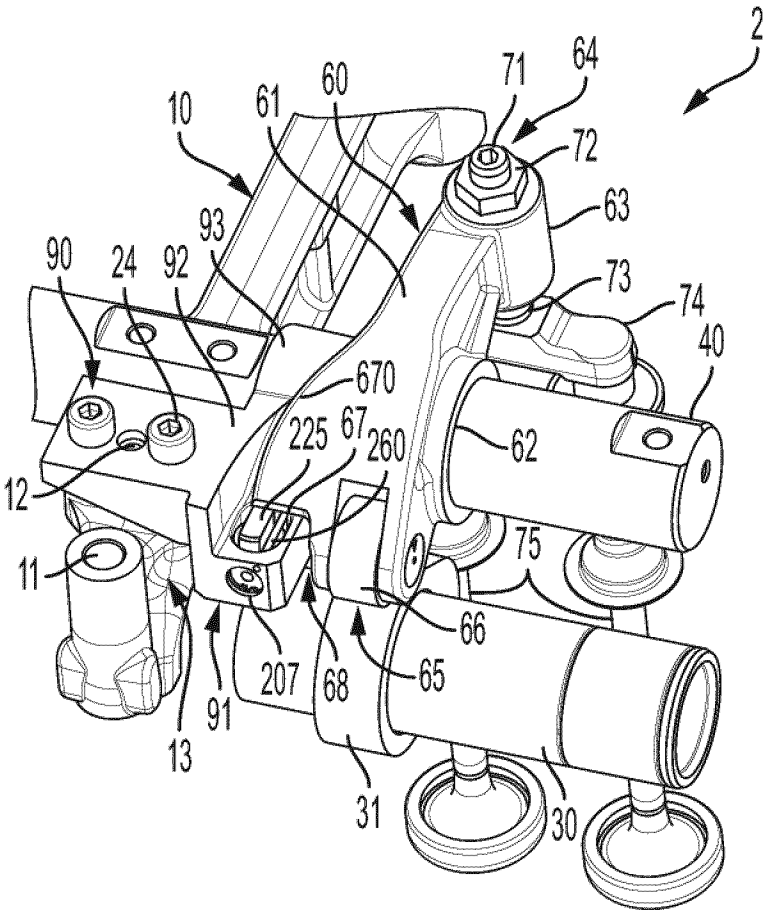
FIGS. 1A-1C show perspective views of alternative shifting stopper latch assemblies and rocker arms in alternative valvetrain setups.

Reference will now be made in detail to the examples which are illustrated in the accompanying drawings.

A shifting stopper 220 for a rocker arm 50, 60 can be used to implement cylinder decompression (CDC). The shifting stopper 220 can enable variable valve actuation (VVA). It can be used in heavy-duty engines to enable Cylinder De-Compression (CDC) mode. Benefits include simplicity and robust design.

Combustion engines are forced to reduce fuel consumption and exhaust emissions. One of the possible ways is to use a Cylinder De-Compression (CDC) system in an engine valvetrain 1, 2, 3. CDC decreases pressure drop in cylinders. It reduces required torque to spin the crank shaft. That is beneficial in numerous usages:

- Start/Stop systems—lower power consumption and lower vibration during repeated starts and stops.
- Hybrid drivetrains—seamless transitions between ICE and e-motor regimes.
- Coasting of vehicles with internal combustion engines (ICE)—substitution of Cylinder De-Activation for lower fuel consumption during low load regimes.

The proposed CDC system comprises a shifting stopper 220 with a simple yet robust design. The design is flexible and can be changed for different engines according to engine layout and space available. But, the design can be customized easily and a robust CDC system can be delivered to OEMs. For example, the shifting stopper 220 can be select-fit for the customer specifications, with the height of the projection 224 driving the extent of the cylinder decompression (extent to which the valves are held open). Now, the shifting stopper 220 can be scaled in one direction while the remainder of the rocker arm 50, 60 remains usable with other customer configurations. The stroke length of the shifting stopper 220 could be adjusted by widening the stopper opening 204 or by keeping it narrower. Then, the travel and extent of the latch surface 57, 67 can vary also for lift height adjustments.

There can be a shifting stopper 220 near a rocker-arm 50, 60. The latch assembly housing 200 for the shifting stopper 220 can be placed in a latch body 81, 91, 101 and can be nested against the rocker arm 50, 60 or can be nested as by being placed in a pocket of the rocker arm 50, 60. The shifting stopper 220 can be pushed by its return spring 230 to an engaged position and it can be pushed by oil control to a piston 210 to a disengaged position. If there is no oil pressure, the piston 210 is not pushing, the shifting stopper 220 is shifted to the engaged position, and the rocker arm movement is limited by the shifting stopper 220 so that the engine valves cannot be closed. See FIGS. 4A & 4B. CDC mode is on. As oil is pressurized, the piston 210 overpowers the return spring 230, the shifting stopper 220 is shifted to the disengaged position, the rocker arm 50, 60 is free to move, the bearing surface (roller bearing or slider pad) 56, 66 follows the cam 31 of rotating cam rail 30, and the engine valves can be closed. CDC mode is off. See FIGS. 3A & 3B.

Advantages can include a simple and robust design, easy to customize for different engines, can be designed without opening and closing ramps, can be acceptable at low rotations per minute of the crankshaft (RPMs) for start/stop systems, and can enable valve profile re-designs.

A shifting stopper latch assembly 2001, for a rocker arm 50, 60 can comprise a latch assembly housing 200, comprising a latch assembly oil port 2021, a piston bore 201, a stopper bore 203 comprising a stopper opening 204, and a spring seat 206. A piston 210 can be in the piston bore 201. A shifting stopper 220 can be in the stopper bore 203 and the shifting stopper 220 can comprise a projection 224 protruding out of the stopper opening 204. A return spring 230 can be configured in the spring seat 206 to bias the shifting stopper 220 and the piston 210 away from the spring seat 206 and towards the latch assembly oil port 2021.

The latch assembly housing 200 can comprise a stepped bore structure including steps such as stopper bore step 2031. The piston 210 can be dropped into the piston bore 201. Piston bore 201 can comprise a piston backwall 202 through which the latch assembly oil port 2021 can supply oil control. A nipple 213 can be formed on the piston body 214 to space the piston 210 from the piston backwall 202 to help oil flow around the piston 210 during oil control.

The latch assembly oil port 2021 can be connected to the oil gallery 41 in the rocker shaft 40 via different connections to rocker shaft oil feed 42. When shifting stopper latch assembly 2001 is mounted in an anchored latch assembly body 80 or in an integrated latch assembly body 100, a portion of latch body 81, 91 can comprise a latch oil feed 941 that can extend from the latch assembly oil port 2021. A rocker arm oil feed 69 can fluidly connect to the latch oil feed 941. When comprising the anchored latch assembly body 90 that comprises latch body 91 and rocker arm extension 93, the latch assembly oil port 2021 can be formed to connect directly with an extension oil feed 94 for fluid communication with rocker shaft oil feed.

Figure 1A:
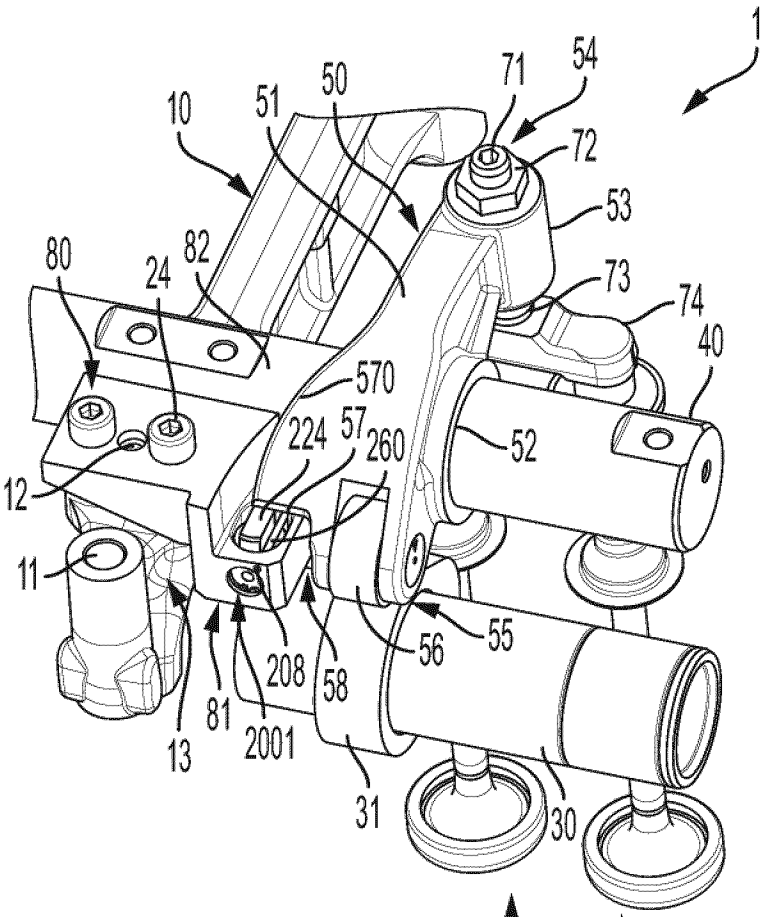
Figure 2:
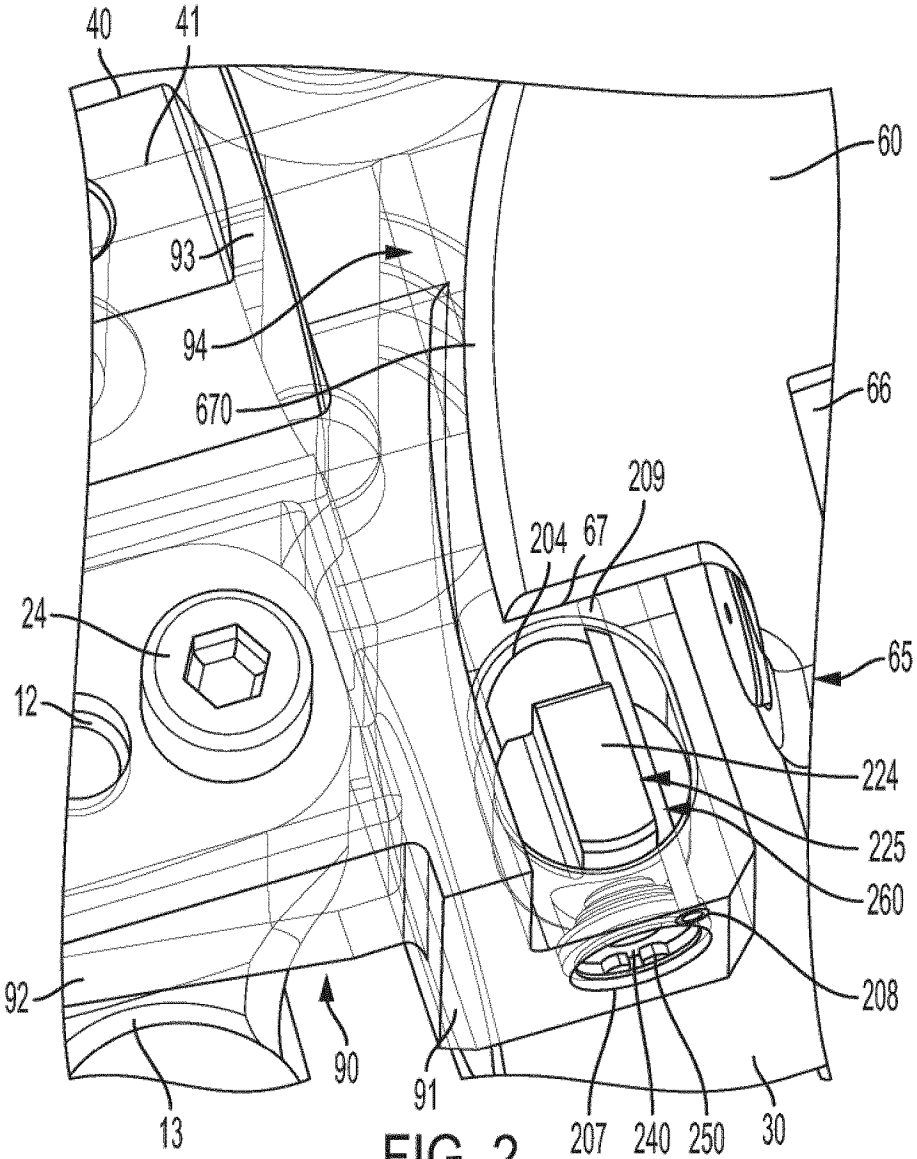
FIG. 2 is a view of one of the shifting stopper latch assemblies.
Figure 1C:
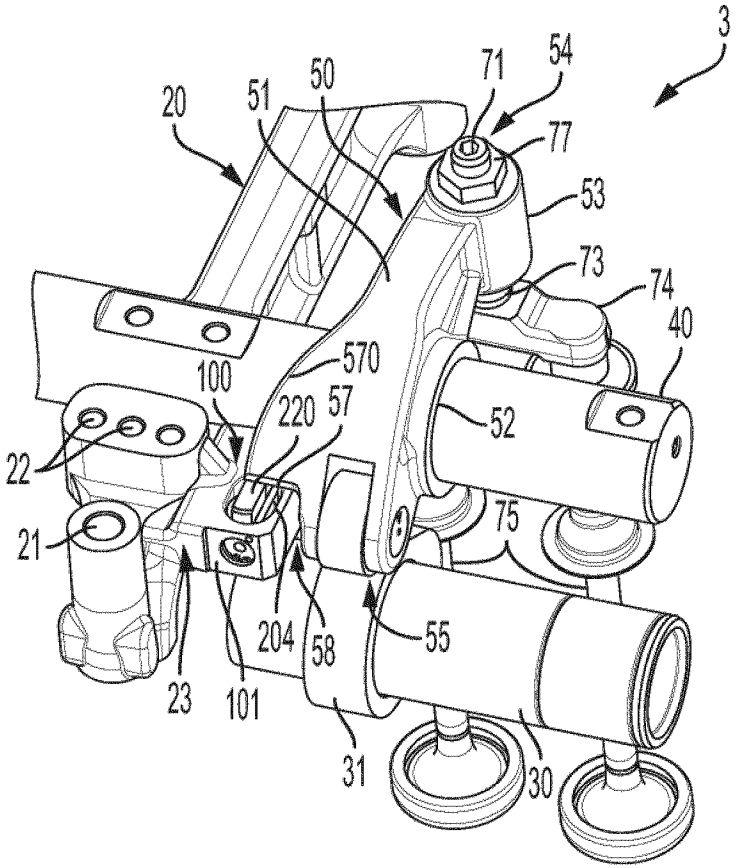

Several alternatives are shown in valvetrains 1, 2, 3. In FIGS. 1A & 1B, a carrier 10 can be mounted to the cylinder head. Rocker shaft 40 is shown with options to stabilize against the carrier 10. Additional mounting holes 11, 12 are shown in the carrier body 13. Brackets 82, 92 can be integrated with latch bodies 81, 91 to anchor the shifting stopper latch assembly 2001 with respect to the carrier 10. Fasteners 24 such as screws, rivets, locating pins, and the like can be used to anchor the brackets 82, 92 to the carrier 10. But in FIG. 1C, the carrier 20 is more integrated. It, too, can stabilize the rocker shaft 40 and can comprise mounting holes 21, 22 in carrier body 23. But in lieu of a bracket, the latch body 101 is integrated with the material of the carrier 20 as an integrated latch assembly body 100. Latch assembly housing 200 is integrated in the carrier body 23 and the carrier body 23 is configured to mount to a cylinder head of an engine, and the carrier body 23 is configured to anchor a rocker shaft 40 to the cylinder head.

The latch assembly housing 200 can be configured with a bracket 92 for mounting to a valvetrain carrier 10. The latch assembly housing 200 can be configured with a rocker arm extension 93. And the rocker arm extension 93 can be configured to receive a rocker shaft 40 in an extension rocker shaft bore 940. Rocker arm extension 93 comprises an extension oil feed 94 from the extension rocker shaft bore 940 to the latch assembly oil port 2021.

The stopper opening 204 of stopper bore 203 can be configured to surround the projection 224 of the shifting stopper 220 for reciprocation in the stopper bore 203. A first opening end wall 2041 and a second opening end wall 2042 of the stopper opening 204 are configured as travel stops for the shifting stopper 220. Alternatively or additionally, stopper bore 203 can comprise a stopper bore step 2031 configured as a travel limit for the shifting stopper 220. Alternatively or additionally, the piston 210 can be configured to protrude from the piston bore 201 to limit the travel of the shifting stopper 220. A first end 211 of piston can protrude from the piston bore 201. The piston 210 can be select-fit to set the position of the shifting stopper 220. With the second end 212 of the piston adjacent to the piston backwall 202, limited by the optional nipple 213, the length of piston body 214 can be chosen to aide in the positioning of the projection 224 relative to the latch surface 57, 67 of the rocker arm 50, 60.

Figure 3B:
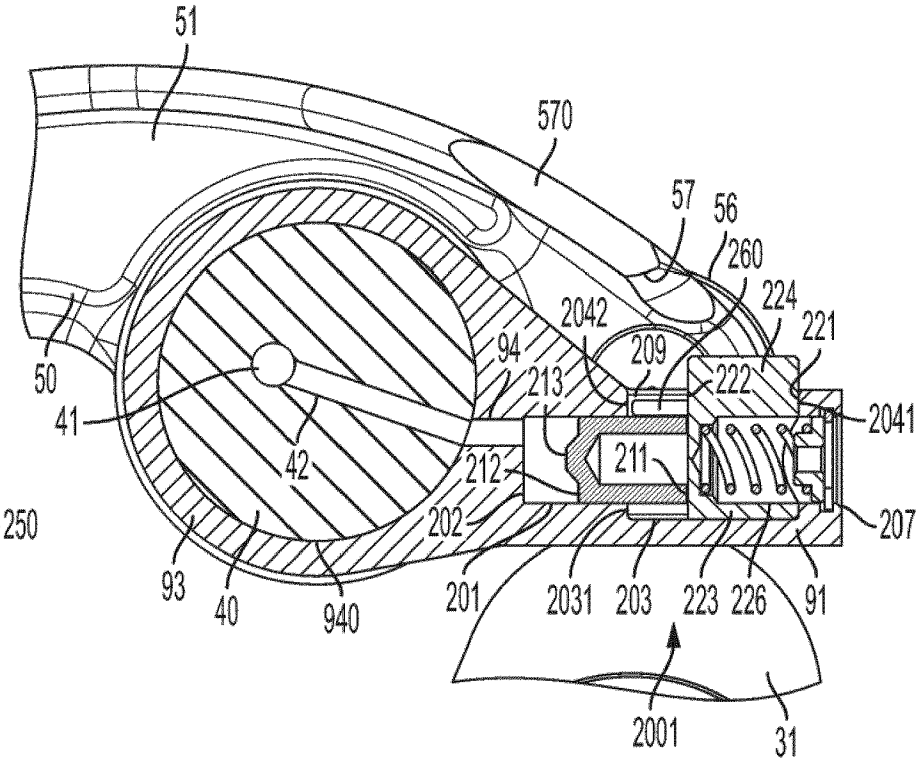
FIGS. 3A & 3B are comparative views of lowered and lifted states of the rocker arm relative to an unlatched shifting stopper latch assembly.
Figure 3A:
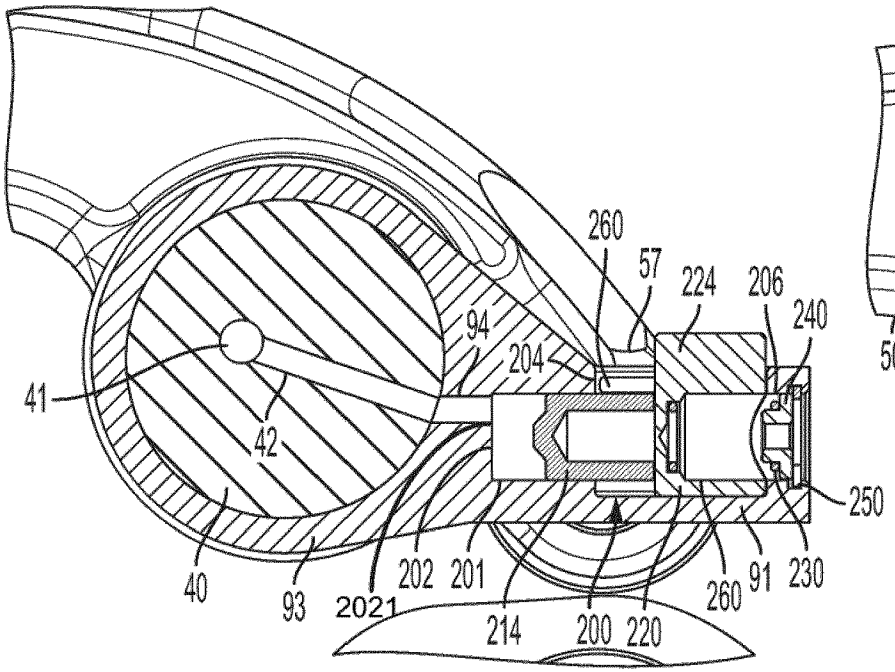
Figure 4B:
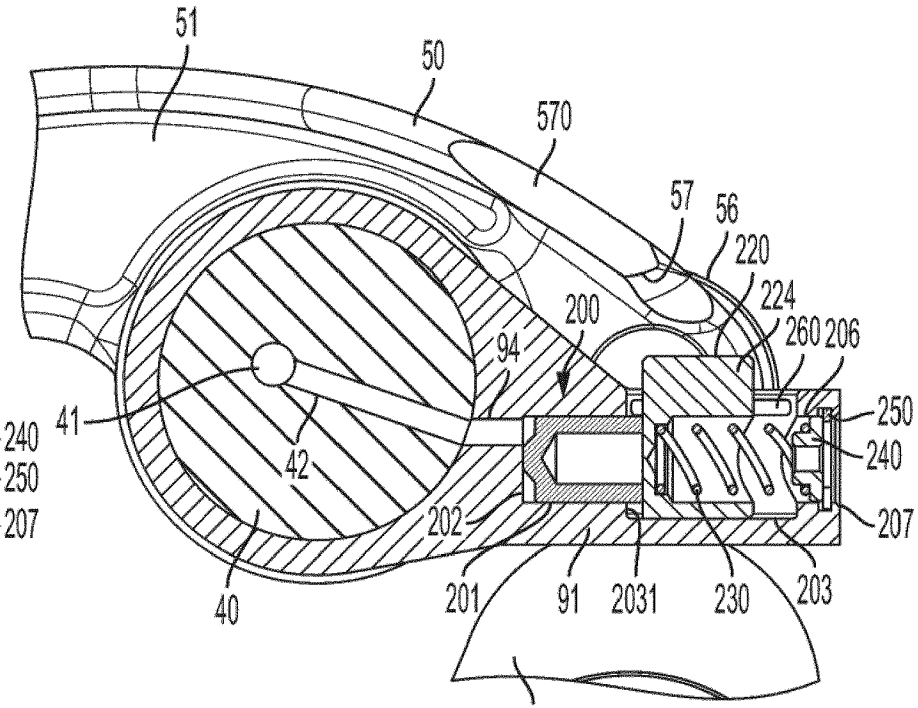
FIGS. 4A & 4B are comparative views of lowered and lifted states of the rocker arm relative to an unlatched shifting stopper latch assembly.
Figure 4A:
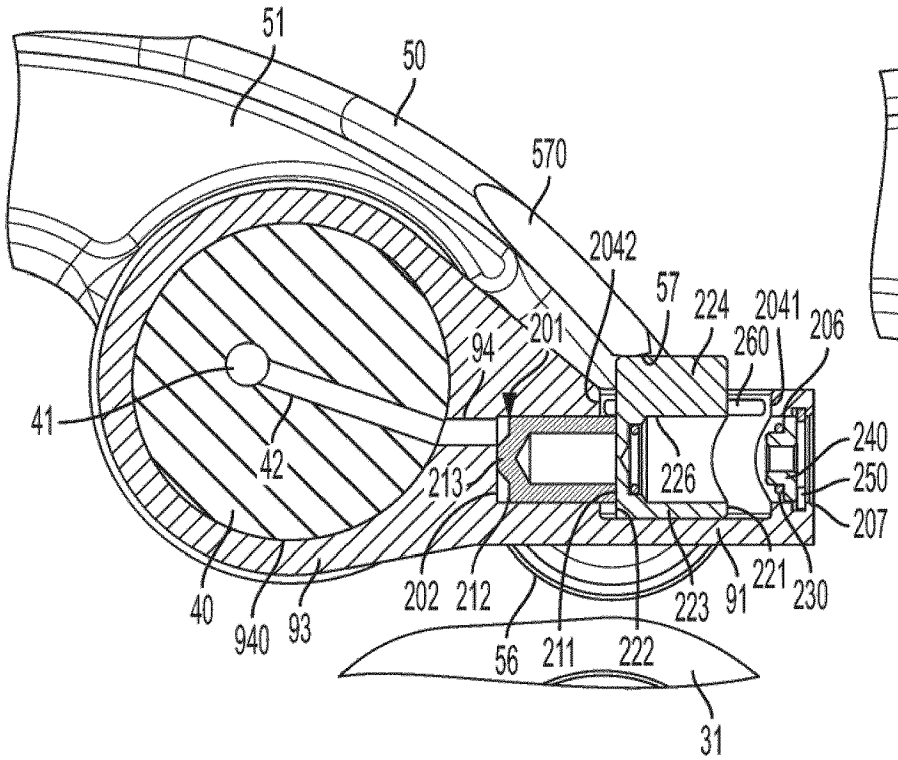
Figure 5:
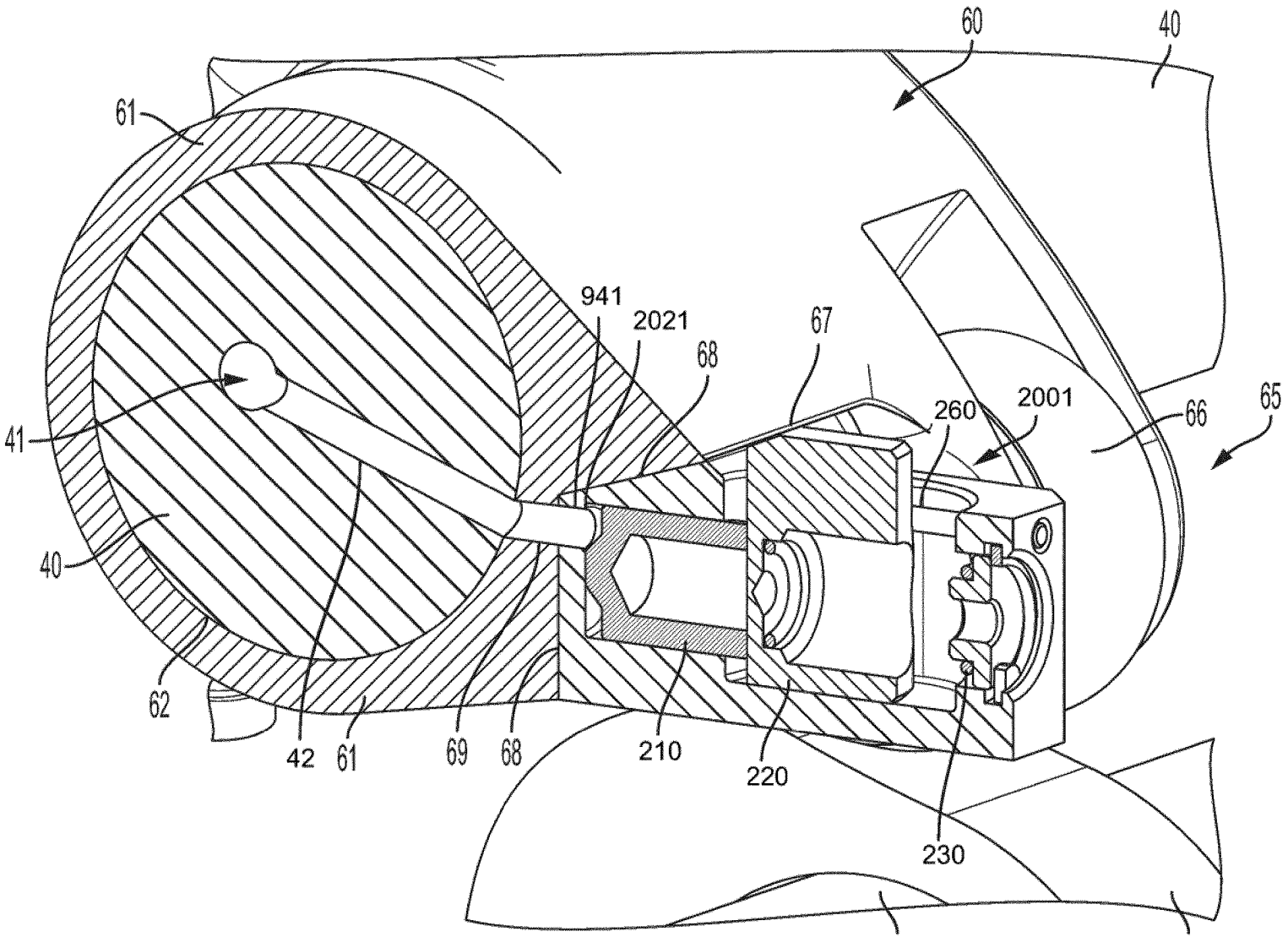
FIG. 5 is a view of an alternative shifting stopper latch assembly and rocker arm therefor.

The shifting stopper latch assembly 2001 is conducive to drop-in assembly techniques for fast and sure assembly. Piston 210 can be dropped through bleed port 207 and into piston bore 201. Shifting stopper 220 can be dropped through stopper opening 204 in stopper bore 203. Then, return spring 230, only the ends of which are illustrated in FIGS. 3A, 4A, & 5, can be dropped into a spring cup 226 in the stopper body 223. A first end 221 of the shifting stopper 220 can be adjacent to the spring seat 206 and a second end 222 of the shifting stopper 220 can be adjacent to the first end 211 of piston 210. With the return spring 230 dropped in, a retainer 240 for the return spring 230 can be configured for drop-in assembly. Retainer 240 can comprise a spring seat and spring guide. Or, a step or ledge can be formed in the spring seat 206. An anchor such as c-clip 250, a bushing, stake, washer, internal nut or the like can lock the components of the shifting stopper latch assembly 2001 in place.

To prevent rotation of the shifting stopper 220, a guide arrangement can be implemented. Guide arrangement can be used so that the spring cup 226 stays aligned in the stopper bore 203, or so that the projection 224 is aligned with the latch surface 57, 67. So, a guide surface 225 can be formed on the shifting stopper 220. Guiding insert can be a pin seated in guide pin slots 208, 209. Guiding insert 260 can be a peg, pin, stake, slat, dowel or other expedient. Guiding insert can also be used to secure the shifting stopper 220 so that it does not fall out through the stopper opening 204. Guiding insert 260 can be mounted across the stopper opening 204 and can be aligned against the guide surface 225.

A valvetrain 1, 2, 3 can comprise a rocker arm 50, 60 configured to actuate against a cam 31 on a cam rail 30. Rocker arm 50, 60 can comprise a latch surface 57, 67 configured to selectively engage and disengage the projection 224. That is, shifting stopper 220 can be configured as shown in FIGS. 3A & 3B to disengage the latch surface 57, 67 by the shifting stopper 220 sliding in the stopper opening 204 to abut the first opening end wall 2041. Or, the shifting stopper can be configured as shown in FIGS. 4A, 4B, & 5 to engage the latch surface 57, 67 by the shifting stopper 220 sliding in the stopper opening 204 to abut the second opening end wall 2042.

Rocker arm 50, 60 comprises rocker arm body 51, 61 through which a rocker shaft bore 52, 62 can be formed. A valve end 53, 63 can comprise an insert bore 54, 64 for receiving an insert 71 such as a spigot, capsule, lash adjuster, piston assembly, castellation device, among other options. A lash nut 72 is illustrated. Valve end 53, 63 can also comprise an e-foot (elephant foot) 73 for actuating one or more valves 75, and so a valve bridge 74 is illustrated with two valves 75.

A cam end 55, 65 of the rocker arm 50, 60 can comprise a bearing surface 56, 66 for actuating against a cam 31 on a cam rail 30. As the cam 31 rotates, it lifts and lowers the rocker arm 50, 60 to actuate the valves 75. When the cam 31 is on base circle, the bearing surface 56, 66 in the cam end 55, 65 is not lifted, so the latch surface 57, 67 is lowered as shown in FIGS. 3A, 4A, & 5. In FIG. 3A, the latch surface 57, 67 clears the shifting stopper 220 and the valves 75 can be fully closed. The latch surface 57, 67 can be said to be adjacent but not abutting the shifting stopper 220. In FIGS. 4A & 5, with the bearing surface on base circle, the valves cannot fully close because the projection 224 interferes with the lowering of the rocker arm. A gap is seen between the cam 31 and the bearing surface 56 in FIG. 4A. The drive mode lift of the valves 75 is not impacted by the shifting stopper latch assembly 2001 because the latch surface 57, 67 can lift away from the projection 224 when the cam 31 rotates to a lift lobe. This can be seen in FIGS. 3B & 4B.

The rocker arm can 50, 60 comprise a body extension 570, 670 adjacent the bearing surface 56, 66 on the cam end 55, 65. The latch surface 57, 67 can be integrated with the body extension 570, 670. The body extension 570, 670 can provide structural integrity to the rocker arm 50, 60, which typically curves between the actuating cams and the valve ends. Body extension 570, 670 can be formed like an overhang with an actuator seat 58, 68 formed underneath. Then, the latch assembly housing 200 can be at least partially nested under the body extension 570, 670. And, when included, the rocker arm extension 93 can be at least partially nested under the body extension 670. The nesting provides a compact valvetrain arrangement. The linear space between the cylinders is maximized by nesting the shifting stopper latch assembly 2001 against the rocker arm 50, 60. Unlike the prior art, the use of vertical and rearward space can be avoided for the mode-switching features.

Other implementations will be apparent to those skilled in the art from consideration of the specification and practice of the examples disclosed herein.

The invention claimed is:

1. A shifting stopper latch assembly for a rocker arm, the shifting stopper latch assembly comprising:
- a latch assembly housing, including:
  - a latch assembly oil feed;
  - a piston bore;
  - a stopper bore with a stopper opening; and
  - a spring seat;
- a piston arranged in the piston bore;
- a shifting stopper arranged in the stopper bore between the piston and the spring seat, the shifting stopper including a projection protruding out of the stopper opening; and
- a return spring arranged in the spring seat so as to bias the shifting stopper and the piston away from the spring seat and towards the latch assembly oil feed,
- wherein in an absence of oil pressure from the latch assembly oil feed, the return spring is configured to push the shifting stopper from a disengaged position to an engaged position in which the projection of the shifting stopper blocks a lowering of a cam end of the rocker arm so as to activate a cylinder decompression mode.

2. The shifting stopper latch assembly of claim 1, further comprising:
- a guiding insert mounted across the stopper opening and aligned against a guide surface on the shifting stopper.

3. The shifting stopper latch assembly of claim 1, wherein the latch assembly housing is integrated in a carrier body configured to mount to a cylinder head.

4. The shifting stopper latch assembly of claim 3, wherein the carrier body is configured to anchor a rocker shaft to the cylinder head.

5. The shifting stopper latch assembly of claim 1, wherein the latch assembly housing further includes a bracket configured to be mounted to a valvetrain carrier.

6. The shifting stopper latch assembly of claim 5, wherein the latch assembly housing further includes a rocker arm extension configured to receive a rocker shaft in an extension rocker shaft bore.

7. The shifting stopper latch assembly of claim 6, wherein the rocker arm extension includes an extension oil feed extending from the extension rocker shaft bore to the latch assembly oil feed.

8. The shifting stopper latch assembly of claim 1, wherein the stopper opening is configured to surround the projection for reciprocation in the stopper bore, and
- wherein the stopper opening includes a first opening end wall and a second opening end wall configured as travel stops for the shifting stopper.

9. The shifting stopper latch assembly of claim 1, wherein the stopper bore includes a stopper bore step configured as a travel limit for the shifting stopper.

10. The shifting stopper latch assembly of claim 1, wherein the piston is configured to protrude from the piston bore so as to limit a travel of the shifting stopper.

11. The shifting stopper latch assembly of claim 1, further comprising a retainer configured for drop-in assembly of the return spring into the shifting stopper and the spring seat.

12. The shifting stopper latch assembly of claim 1, wherein, during the cylinder decompression mode, an extent to which valves are held open corresponds to a height of the projection of the shifting stopper.

13. A valvetrain comprising:
- a rocker arm configured to actuate against a cam on a cam rail; and
- a shifting stopper latch assembly for the rocker arm, the shifting stopper latch assembly comprising:
  - a latch assembly housing, including:
    - a latch assembly oil feed;
    - a piston bore;
    - a stopper bore with a stopper opening; and
    - a spring seat;
  - a piston arranged in the piston bore;
  - a shifting stopper arranged in the stopper bore between the piston and the spring seat, the shifting stopper including a projection protruding out of the stopper opening; and
  - a return spring arranged in the spring seat so as to bias the shifting stopper and the piston away from the spring seat and towards the latch assembly oil feed,
  - wherein in an absence of oil pressure from the latch assembly oil feed, the return spring is configured to push the shifting stopper from a disengaged position to an engaged position in which the projection of the shifting stopper blocks a lowering of a cam end of the rocker arm so as to activate a cylinder decompression mode.

14. The valvetrain of claim 13, wherein the rocker arm includes a body extension adjacent to a bearing surface on the cam end of the rocker arm.

15. The valvetrain of claim 14, wherein the latch assembly housing is at least partially nested under the body extension.

16. The valvetrain of claim 14, wherein the latch assembly housing further includes a rocker arm extension nested under the body extension.

* * * * *